US011152176B2

(12) United States Patent
Watanabe

(10) Patent No.: US 11,152,176 B2
(45) Date of Patent: Oct. 19, 2021

(54) RELAY CONTROL DEVICE

(71) Applicant: Mitsubishi Electric Corporation, Tokyo (JP)

(72) Inventor: Yasuhiro Watanabe, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 27 days.

(21) Appl. No.: 16/488,252

(22) PCT Filed: May 8, 2017

(86) PCT No.: PCT/JP2017/017372
§ 371 (c)(1),
(2) Date: Aug. 23, 2019

(87) PCT Pub. No.: WO2018/207231
PCT Pub. Date: Nov. 15, 2018

(65) Prior Publication Data
US 2020/0321177 A1 Oct. 8, 2020

(51) Int. Cl.
*H01H 47/10* (2006.01)
*H01H 47/32* (2006.01)

(52) U.S. Cl.
CPC ..... *H01H 47/10* (2013.01); *H01H 47/32* (2013.01)

(58) Field of Classification Search
CPC ..... H01H 47/00; H01H 47/04; H01H 47/10; H01H 47/22; H01H 47/32
USPC ..... 361/154, 160
See application file for complete search history.

(56) References Cited

U.S. PATENT DOCUMENTS 5,085,574 A * 2/1992 Wilson ..... F23N 5/242 431/6
5,210,756 A * 5/1993 Kummer ..... G05B 9/03 714/10
5,568,349 A * 10/1996 Kowalewski ..... H01H 47/04 361/154
(Continued)

FOREIGN PATENT DOCUMENTS

JP S55-003665 A 1/1980
JP 2001-091013 A 4/2001
(Continued)

OTHER PUBLICATIONS

Office Action dated Mar. 24, 2020 issued in corresponding JP patent application No. 2019-516749 (and English translation).
(Continued)

*Primary Examiner* — Yemane Mehari
(74) *Attorney, Agent, or Firm* — Posz Law Group, PLC

(57) ABSTRACT

A relay control device includes a coil, a movable iron armature that is switched from an open state to a closed state when the coil is excited, a switching current output circuit that applies first current for switching the movable iron armature from the open state to the closed state to the coil, and a holding current output circuit that applies second current for holding the movable iron armature in the closed state to the coil. The switching current output circuit applies the first current to the coil when a first time has elapsed from when the second current is started to be applied to the coil, and the value of the second current is lower than the value of the first current.

3 Claims, 5 Drawing Sheets

(56) References Cited

U.S. PATENT DOCUMENTS

| | | | | |
|---|---|---|---|---|
| 6,236,552 | B1 * | 5/2001 | Hattori | H01H 47/04 361/154 |
| 6,518,764 | B2 * | 2/2003 | Shirato | H01H 47/325 324/413 |
| 8,212,389 | B2 * | 7/2012 | Morimoto | H01H 47/043 307/30 |
| 2020/0321177 | A1 * | 10/2020 | Watanabe | H01H 47/10 |

FOREIGN PATENT DOCUMENTS

| | | | |
|---|---|---|---|
| JP | 2009-289671 | A | 12/2009 |
| JP | 4378585 | B2 | 12/2009 |
| JP | 2014-116197 | A | 6/2014 |

OTHER PUBLICATIONS

Extended European Search Report dated Apr. 17, 2020 in the corresponding EP patent application No. 17908987.5.
International Search Report of the International Searching Authority dated Jul. 25, 2017 in corresponding international application No. PCT/JP2017/017372 (and English translation).
Office Action dated Jul. 17, 2020 issued in the corresponding IN patent application No. 201947042278(with English translation).
Office Action dated Jan. 6, 2021 issued in the corresponding CN patent application No. 201780089177.5 (and English translation).
Office Action dated Apr. 24, 2020 in the corresponding Australian patent application No. 2017413249.

* cited by examiner

RELAY CONTROL DEVICE

CROSS REFERENCE TO RELATED APPLICATION

This application is a U.S. national stage application of International Patent Application No. PCT/JP2017/017372 filed on May 8, 2017, the disclosure of which is incorporated herein by reference.

TECHNICAL FIELD

The present invention relates to a relay control device that controls a mechanical relay.

BACKGROUND

Patent Literature 1 teaches a technology of intermittently outputting current for switching a relay, which is a mechanical relay, from an open state to a closed state to automatically restore the relay to the closed state in anticipation of a case where the closed state of a relay can no longer be held owing to instant voltage drop while current for holding the relay in the closed state is output. Hereinafter, the current output for holding the relay in the closed state will be referred to as holding current output, and the current output for switching the relay from the open state to the closed state will be referred to as switching current output.

PATENT LITERATURE

Patent Literature 1: Japanese Patent No. 4378585

The relay control method taught in Patent Literature 1, however, has a problem in that components with high absolute maximum rated current need to be used for a relay and relay peripheral circuit components arranged around the relay because a large inrush current flows to the relay and the relay peripheral circuit components at the switching current output.

SUMMARY

The present invention has been made in view of the above, and provides a relay control device capable of suppressing inrush current to a relay.

To solve the aforementioned problems and achieve the object, a relay control device according to the present invention includes: a coil; a movable iron armature switched from an open state to a closed state when the coil is excited; a switching current output circuit to apply first current for switching the movable iron armature from the open state to the closed state to the coil; and a holding current output circuit to apply second current for holding the movable iron armature in the closed state to the coil. The switching current output circuit applies the first current to the coil when a first time has elapsed from when the second current started to be applied to the coil, and a value of the second current is lower than a value of the first current.

A relay control device according to the present invention produces an effect of suppressing inrush current to a relay.

DETAILED DESCRIPTION

A relay control device according to an embodiment of the present invention will be described in detail below with reference to the drawings. Note that the present invention is not limited to the embodiment.

EMBODIMENT

Figure 1:
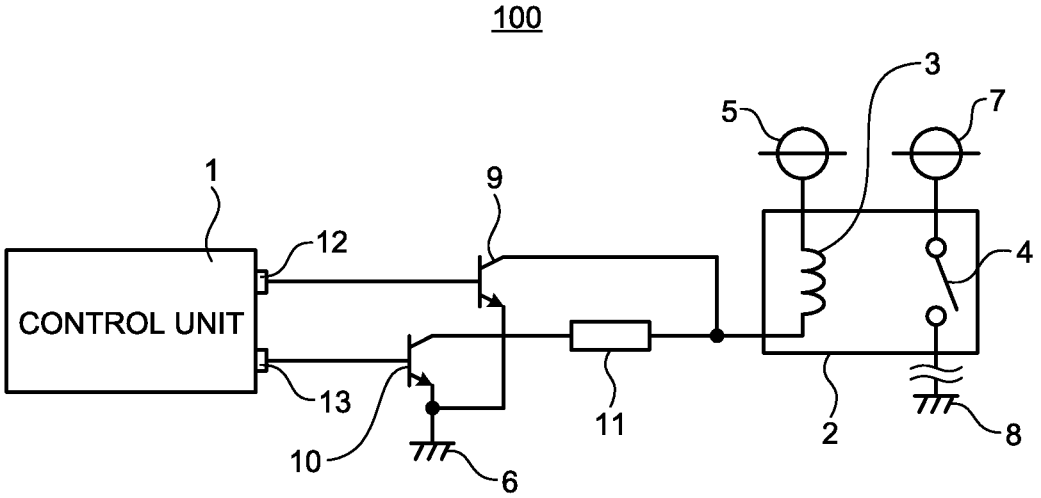
FIG. 1 is a configuration diagram of a relay control device according to an embodiment of the present invention.

FIG. 1 is a configuration diagram of a relay control device according to an embodiment of the present invention. A relay control device 100 according to the embodiment includes a relay 2 including a coil 3 and a movable iron armature 4, a control unit 1 including a switching current output port 12 and a holding current output port 13 for controlling the operation of the movable iron armature 4, a switching current output transistor 9 connected with the switching current output port 12 of the control unit 1, a holding current output transistor 10 connected with the holding current output port 13 of the control unit 1, and a current limiting resistor 11 having one end connected with the holding current output transistor 10 and the other end connected with the switching current output transistor 9 and one end of the coil 3.

The switching current output port 12 and the holding current output port 13 are digital output ports of the control unit 1.

The switching current output transistor 9 controls current flowing through the coil 3 depending on a state of a signal output from the switching current output port 12. A signal output from the switching current output port 12 has a potential of two values, that is, a high level or a low level.

The holding current output transistor 10 controls current flowing through the coil 3 depending on a state of a signal output from the holding current output port 13. A signal output from the holding current output port 13 has a potential of two values, that is, a high level or a low level.

Examples of the switching current output transistor 9 and the holding current output transistor 10 include bipolar transistors, field effect transistors (FETs), metal oxide semiconductor field effect transistors (MOSFETs), insulated gate bipolar transistors (IGBTs) and insulated gate controlled thyristors (IGCTs). In the present embodiment, npn bipolar transistors are used for the switching current output transistor 9 and the holding current output transistor 10.

The collector of the switching current output transistor 9 is connected with the other end of the current limiting resistor 11 and with one end of the coil 3. The base of the switching current output transistor 9 is connected with the switching current output port 12. The emitter of the switching current output transistor 9 is connected with the emitter of the holding current output transistor 10 and with a primary side ground 6.

The collector of the holding current output transistor 10 is connected with one end of the current limiting resistor 11. The base of the holding current output transistor 10 is connected with the holding current output port 13. The emitter of the holding current output transistor 10 is connected with the primary side ground 6 and with the emitter of the switching current output transistor 9.

The other end of the coil 3 is connected with a primary side power supply 5. One end of the movable iron armature 4 is connected with a secondary side power supply 7. The other end of the movable iron armature 4 is connected with a secondary side ground 8.

The coil 3 is excited when direct current supplied from the primary side power supply 5 flows to the primary side ground 6. The movable iron armature 4 is a normally-open movable component including a magnetic iron piece, and serves as a switch for opening and closing the secondary side power supply 7. The movable iron armature 4 has restoring force of restoring from a closed state to an open state. Note that the restoring force of the movable iron armature 4 is force produced by an elastic member such as a leaf spring or a coil spring. When current flows through the coil 3 and the coil 3 is thus excited, the movable iron armature 4 is attracted to the coil 3 and switched from the open state to the closed state. In this process, the secondary side power supply 7 and the secondary side ground 8 become electrically connected with each other, and power supply to circuit components of a secondary side circuit is started. The secondary side circuit includes the movable iron armature 4, the secondary side power supply 7, and the secondary side ground 8. Description of elements constituting the secondary side circuit other than the movable iron armature 4, the secondary side power supply 7, and the secondary side ground 8 will be omitted.

When the flow of direct current from the primary side power supply 5 to the primary side ground 6 is stopped, the magnetic force generated in the coil 3 is decreased, and the movable iron armature 4 is restored to the open state. Power supply to the secondary side circuit is thus shut off.

Typically, in the relay 2, the value of current required for switching the movable iron armature 4 from the open state to the closed state and the value of current required for holding the closed state of the movable iron armature 4 after being switched to the closed state are different from each other. For convenience sake, the current required for switching the movable iron armature 4 from the open state to the closed state will be referred to as switching current, and the current required for holding the closed state of the movable iron armature 4 after being switched to the closed state will be referred to as holding current. The value of the switching current is larger than that of the holding current, and required current amounts are specified in a product specification of the relay 2.

In the present embodiment, excitation of the coil 3 is performed by two circuits, that is, a switching current output circuit constituted by the switching current output transistor 9 and a holding current output circuit constituted by the holding current output transistor 10 and the current limiting resistor 11.

The presence and absence of current flowing between the collector and the emitter of the switching current output transistor 9 are switched by an output from the switching current output port 12. When the output from the switching current output port 12 is set to the high level, current flows between the collector and the emitter of the switching current output transistor 9. For exciting the coil 3 by the switching current output circuit, current larger than the switching current specified in the product specification of the relay 2 flows through the coil 3.

The current limiting resistor 11 is arranged in series between the holding current output transistor 10 and the coil 3. The presence and absence of current flowing between the collector and the emitter of the holding current output transistor 10 are switched by an output from the holding current output port 13. When the output from the holding current output port 13 is set to the high level, current flows between the collector and the emitter of the holding current output transistor 10.

For exciting the coil 3 by the holding current output circuit, current larger than the holding current specified in the product specification of the relay 2 and smaller than the switching current flows through the coil 3. In this process, the amount of the aforementioned holding current can be adjusted by the current limiting resistor 11, and adjustment of the resistance depending on the model of the relay 2, for example, enables the relay control circuit to be mounted on various products.

Figure 2:
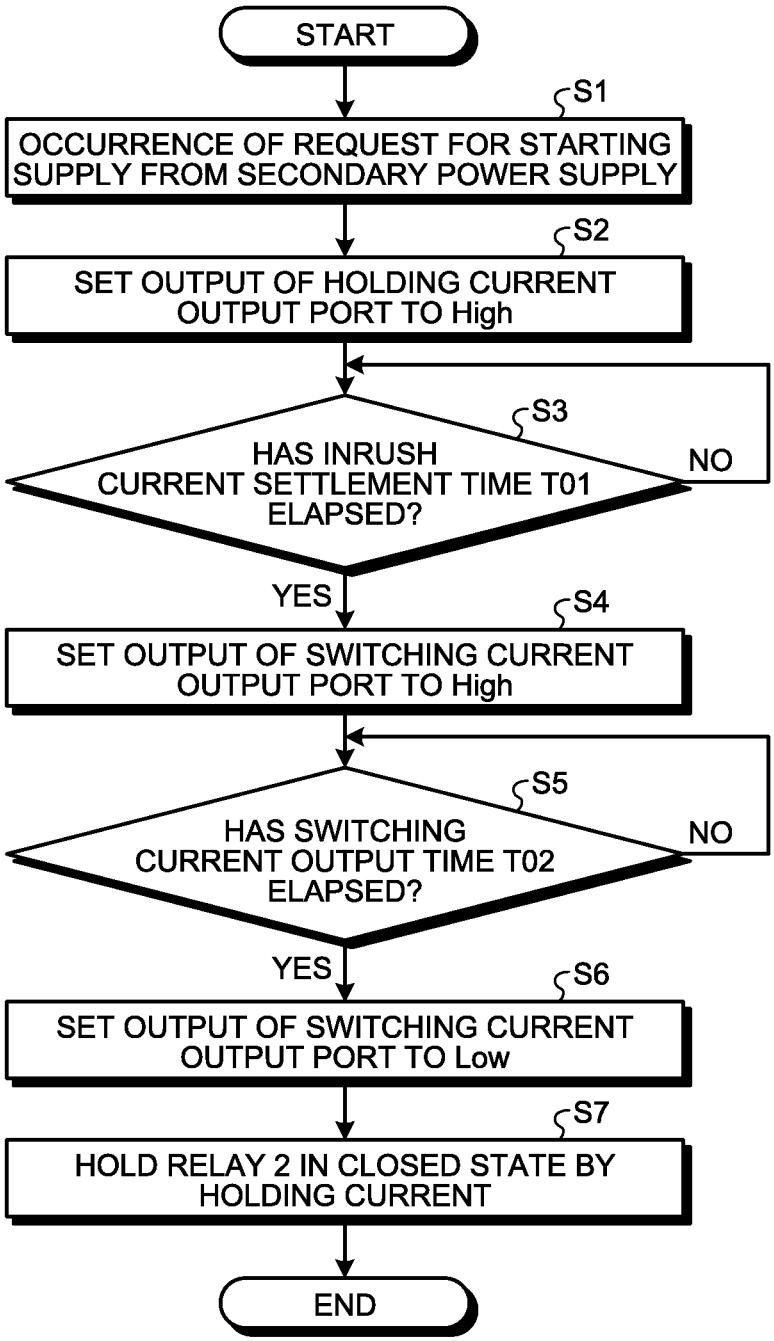
FIG. 2 is a flowchart of switching a relay illustrated in FIG. 1 from an open state to a closed state.
Figure 3:
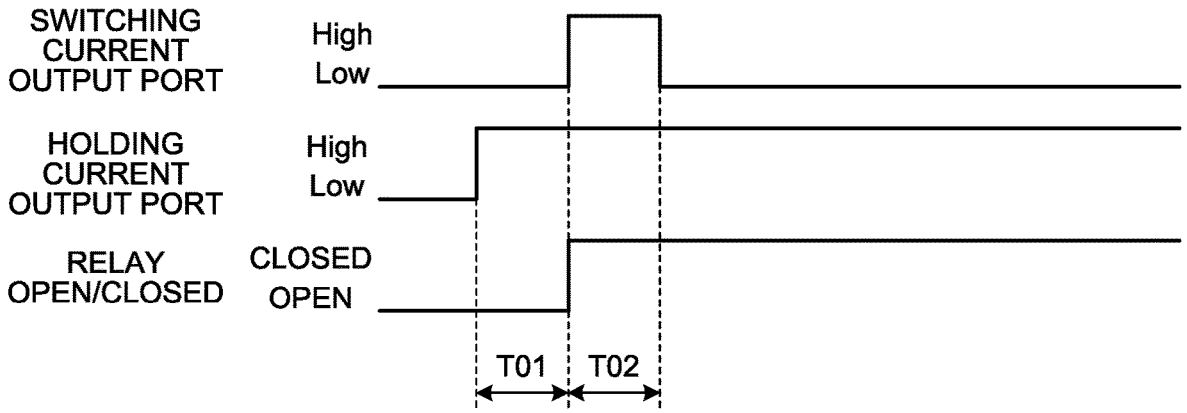
FIG. 3 is a chart illustrating output conditions of the switching current output port and holding current output port in association with the open/closed state of the relay illustrated in FIG. 1 when the relay is switched from the open state to the closed state.

Next, operation of the relay control device 100 according to the present embodiment will be described. FIG. 2 is a flowchart of switching the relay illustrated in FIG. 1 from the open state to the closed state. FIG. 3 is a chart illustrating the output conditions of the switching current output port and holding current output port in association with the open/closed state of the relay illustrated in FIG. 1 when the relay is switched from the open state to the closed state.

When the outputs from the switching current output port 12 and the holding current output port 13 are both set to the low level, the relay 2 is in the open state. At this point, when the control unit 1 is requested to start supply from the secondary side power supply (step S1), the control unit 1 sets the output of the holding current output port 13 to High (step S2).

The control unit 1 measures the time that has elapsed from the time point when the output of the holding current output port 13 was set to the high level in step S2, and determines whether or not the time that has elapsed exceeds an inrush current settlement time T01 that is a first time, that is, whether or not the inrush current settlement time T01 has elapsed (step S3).

When the inrush current settlement time T01 has not elapsed (step S3: No), the control unit 1 repeats the process in step S3. The inrush current settlement time T01 is assumed to be obtained from the time until the inrush current settles down; for example, when the time until the inrush current settles down is 1 [ms], the inrush current settlement time T01 is set to such a value as 100 [ms] with sufficient likelihood.

Because the current limiting resistor 11 is provided in the holding current output circuit, the peak of the inrush current is lower and the time until the inrush current settles down is shorter than those in a case where the relay 2 is switched to the closed state by the switching current output circuit alone. This is because current is applied to the coil 3 via the current limiting resistor 11 of the holding current output circuit and then applied to the coil 3 via the switching current output circuit, which suppresses the magnitude of the inrush current as compared with a case where application of current to the coil 3 is started without the current limiting resistor 11.

When the inrush current settlement time T01 has elapsed (step S3: Yes), the control unit 1 sets the output of the switching current output port 12 to the high level (step S4). At this point, the relay 2 is switched from the open state to the closed state, and power supply to the secondary side circuit is started.

The control unit 1 measures the time that has elapsed from the time point when the output of the switching current output port 12 was set to the high level in step S4, and determines whether or not the time that has elapsed exceeds a switching current output time T02 that is a second time, that is, whether or not the switching current output time T02 has elapsed (step S5). When the switching current output time T02 has not elapsed (step S5: No), the control unit 1 repeats the process in step S5.

In a typical relay 2, the time for which the switching current needs to be continuously output for switching the relay 2 from the open state to the closed state is specified in a product specification. Hereinafter, this time will be referred to as a switching stabilizing time T03. The switching current output time T02 is set to a time obtained from the switching stabilizing time T03 and consideration of likelihood. For example, when the switching stabilizing time T03 is 100 [ms], the switching current output time T02 is set to 10 [s], so that sufficient time is allowed for the relay 2 to be switched to the closed state. Note that the control unit 1 can perform processes other than relay control while waiting for the switching current output time T02 to elapse.

When the switching current output time T02 has elapsed (step S5: Yes), the control unit 1 sets the output of the switching current output port 12 to the low level (step S6). As a result of setting of the switching current output port 12 to the low level, the relay 2 is held in the closed state by the holding current (step S7). At this point, because the current limiting resistor 11 is provided in the holding current output circuit, current flowing through the coil 3 is reduced. Specifically, the value of current flowing to the coil 3 and the holding current output transistor 10 via the current limiting resistor 11 is smaller than the value of current flowing to the coil 3 and the switching current output transistor 9 without passing through the current limiting resistor 11. Thus, the power consumed by the coil 3 while the relay 2 is held in the closed state by the holding current is smaller than that consumed by the coil 3 while the relay 2 is held in the closed state by switching holding current.

Figure 4:
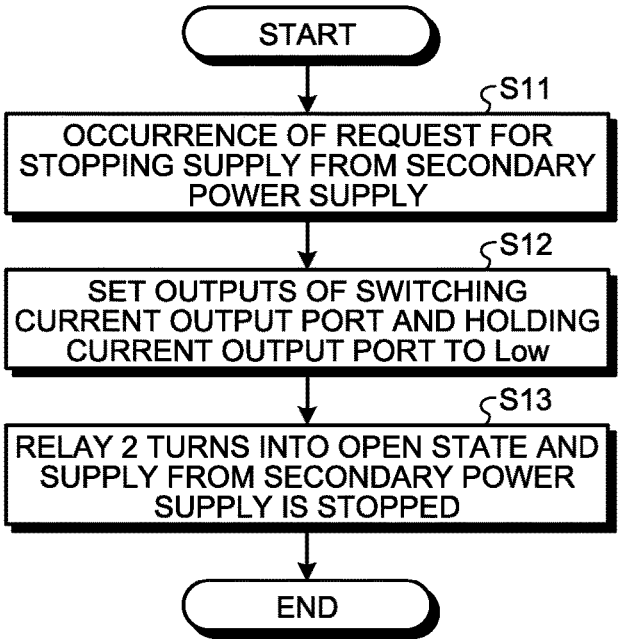
FIG. 4 is a flowchart of switching the relay illustrated in FIG. 1 from the closed state to the open state.
Figure 5:
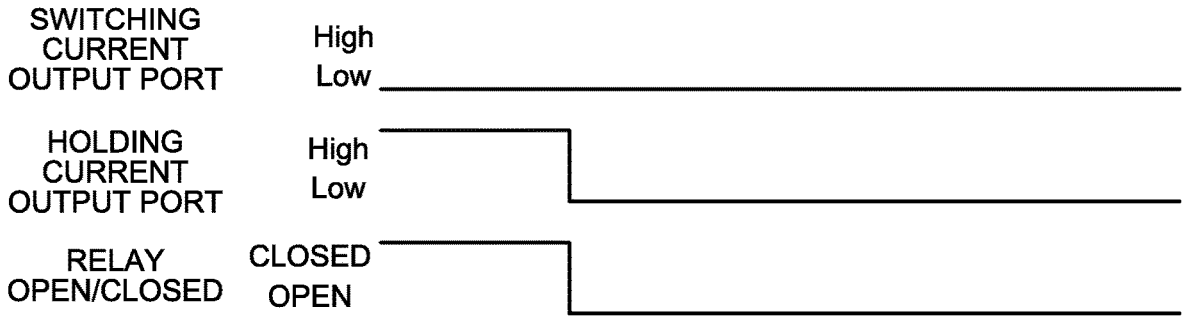
FIG. 5 is a chart illustrating output conditions of the switching current output port and holding current output port in association with the open/closed state of the relay when the relay is switched from the closed state to the open state.

FIG. 4 is a flowchart of switching the relay illustrated in FIG. 1 from the closed state to the open state. FIG. 5 is a chart illustrating the output conditions of the switching current output port and holding current output port in association with the open/closed state of the relay when the relay is switched from the closed state to the open state. Note that the state in which the relay 2 is held in the closed state by the holding current in step S7 described above is the initial state of the explanation of FIGS. 4 and 5.

When the control unit 1 is requested to stop supply from the secondary side power supply while the relay 2 is held in the closed state (step S11), the control unit 1 sets the outputs of the switching current output port 12 and the holding current output port 13 to the low level (step S12). Because current does not flow to the coil 3 any longer as a result of the setting in step S12, the magnetic force of the coil 3 is decreased, and the movable iron armature 4 is restored to the open state. As a result, power supply to the secondary side circuit is shut off (step S13).

Note that, when a request for stopping supply from the secondary side power supply occurs between during the inrush current settlement time T01 or the switching current output time T02 as well, the relay 2 can be turned into the open state by the processes in the order in FIG. 4. A specific example will be described with reference to FIGS. 6 and 7.

Figure 6:
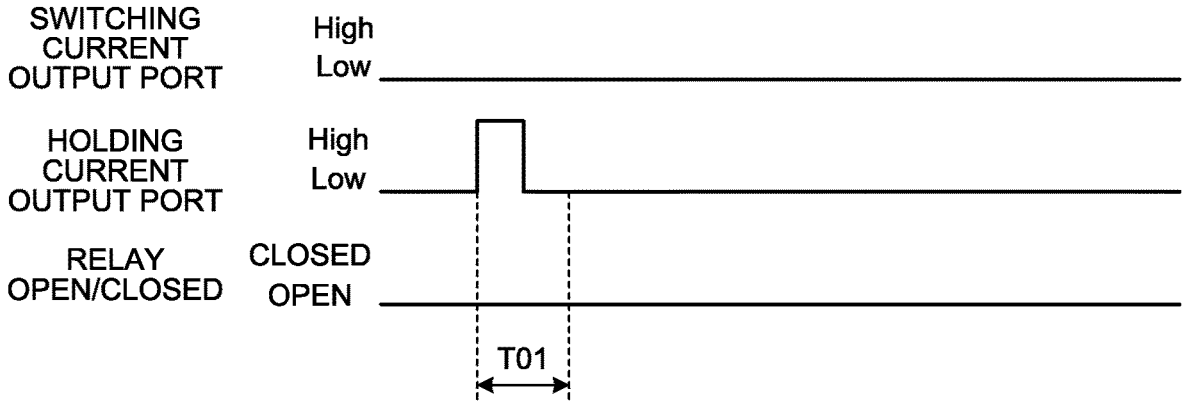
FIG. 6 is a chart illustrating the output conditions of the switching current output port and the holding current output port in association with the open/closed state of the relay when a request for stopping supply from the secondary side power supply occurs before the inrush current settlement time elapses.

FIG. 6 is a chart illustrating the output conditions of the switching current output port and the holding current output port in association with the open/closed state of the relay when a request for stopping supply from the secondary side power supply occurs before the inrush current settlement time elapses. As illustrated in FIG. 6, when a request for stopping supply from the secondary side power supply occurs before the inrush current settlement time T01 elapses, the control unit 1 sets the output of the holding current output port 13 to the low level. As a result, the relay 2 is maintained in the open state without being switched to the closed state.

Figure 7:
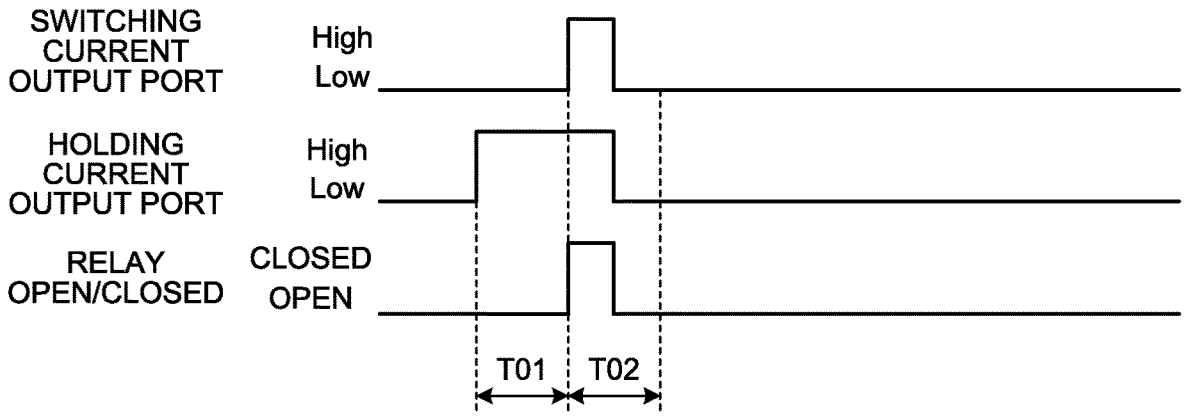
FIG. 7 is a chart illustrating the output conditions of the switching current output port and the holding current output port in association with the open/closed state of the relay when a request for stopping supply from the secondary side power supply occurs before the switching current output time elapses.

FIG. 7 is a chart illustrating the output conditions of the switching current output port and the holding current output port in association with the open/closed state of the relay when a request for stopping supply from the secondary side power supply occurs before the switching current output time elapses. As illustrated in FIG. 7, when a request for stopping supply from the secondary side power supply occurs before the switching current output time T02 elapses, the control unit 1 sets the output of the switching current output port 12 to the low level. As a result, the relay 2 is switched from the closed state to the open state.

According to the related art typified by Patent Literature 1, the switching current output circuit controls opening and closing of a relay, and a large inrush current thus flows to the relay and relay peripheral circuit components arranged around the relay at switching current output. Circuit components with high absolute maximum rated current therefore need to be used for the relay and the relay peripheral circuit components. Because circuit components with high absolute maximum rated current are expensive, this is an obstacle to reduction in product cost.

The relay control device 100 according to the present embodiment includes the coil 3, the movable iron armature 4 that is switched from the open state to the closed state when the coil 3 is excited, the switching current output transistor 9 that is the switching current output circuit that applies first current for switching the movable iron armature 4 from the open state to the closed state to the coil 3, and the holding current output transistor 10 that is the holding current output circuit that applies second current for holding the closed state of the movable iron armature 4 to the coil 3. In addition, the switching current output circuit is configured to apply the first current to the coil 3 when a first time has elapsed from when the second current started to be applied to the coil 3, the value of the second current being lower than that of the first current. According to this configuration, because the first current is applied to the coil 3 after the second current is applied to the coil 3, the peak value of the inrush current is low. Thus, circuit components with low absolute maximum rated current that are low in cost can be used.

In addition, the relay control device 100 according to the present embodiment includes the switching current output circuit, and the holding current output circuit including the current limiting resistor 11 connected in series with the coil 3, the switching current output circuit applies the first current to the coil 3 from when the first time has elapsed until the second time elapses, and the second current is applied to the coil 3 and the current limiting resistor 11 instead of the first current after the second time has elapsed. Thus, the relay 2 is controlled by switching between two circuits, so that, after the relay 2 is switched to the closed state by the switching current output circuit, the closed state of the relay 2 is maintained only by the holding current output circuit. This configuration enables the power consumed by the coil 3 while the relay 2 is held in the closed state by the holding current to be smaller than that consumed by the coil 3 while the relay 2 is held in the closed state by switching holding current.

The configurations presented in the embodiment above are examples of the present invention, which can be combined with other known technologies or can be partly omitted or modified without departing from the scope of the present invention.

The invention claimed is:

1. A relay control device comprising:

a first power supply;

a second power supply, the second power supply being separate from the first power supply;

a coil having a first end connected with the first power supply;

a movable iron armature having a first end connected with the second power supply, the movable iron armature being switched from an open state to a closed state when the coil is excited;

a switching current output circuit having a first end connected with a second end of the coil, to apply current supplied from the first power supply via the coil, as first current for switching the movable iron armature from the open state to the closed state, to the coil; and a holding current output circuit having one end connected with the second end of the coil, to apply current supplied from the first power supply via the coil, as second current for holding the movable iron armature in the closed state, to the coil, wherein the switching current output circuit applies the first current to the coil when an inrush current settlement time has elapsed from when the second current is started to be applied to the coil, and a value of the second current is lower than a value of the first current.

2. The relay control device according to claim 1, wherein the holding current output circuit includes a resistor connected in series with the coil, the switching current output circuit applies the first current to the coil from when the first time has elapsed until a second time elapses, and the second current is applied to the coil and the resistor instead of the first current after the second time has elapsed.

3. The relay control device according to claim 1, wherein the inrush current settlement time is obtained from a time until an inrush current settles down.

* * * * *